US009564283B2

(12) United States Patent
Hemberg et al.

(10) Patent No.: US 9,564,283 B2
(45) Date of Patent: Feb. 7, 2017

(54) LIMITING MIGRATION OF TARGET MATERIAL

(75) Inventors: Oscar Hemberg, Kista (SE); Tomi Tuohimaa, Kista (SE); Per Takman, Kista (SE)

(73) Assignee: EXCILLUM AB, Kista (SE)

( * ) Notice: Subject to any disclaimer, the term of this patent is extended or adjusted under 35 U.S.C. 154(b) by 288 days.

(21) Appl. No.: 14/408,085

(22) PCT Filed: Jun. 14, 2012

(86) PCT No.: PCT/EP2012/061352

§ 371 (c)(1),
(2), (4) Date: Dec. 15, 2014

(87) PCT Pub. No.: WO2013/185829

PCT Pub. Date: Dec. 19, 2013

(65) Prior Publication Data

US 2015/0179388 A1 Jun. 25, 2015

(51) Int. Cl.
*H01J 29/62* (2006.01)
*H01J 35/04* (2006.01)
(Continued)

(52) U.S. Cl.
CPC ..... *H01J 29/62* (2013.01); *G21K 1/08* (2013.01); *G21K 5/04* (2013.01); *H01J 35/04* (2013.01);
(Continued)

(58) Field of Classification Search
CPC ..... H01J 35/14; H01J 35/16; H01J 35/06; H01J 2235/087; H01J 2235/1204; H01J 35/04; H01J 35/30; H01J 2235/165; H01J 35/00
See application file for complete search history.

(56) References Cited

U.S. PATENT DOCUMENTS

2007/0051907 A1* 3/2007 Reinhold ..... H01J 35/02 250/504 R
2007/0086571 A1 4/2007 Hempel et al.
2012/0133265 A1 5/2012 Kakonyi

FOREIGN PATENT DOCUMENTS

JP 2004-220975 A 8/2004
WO WO 2008/047267 A2 4/2008
(Continued)

OTHER PUBLICATIONS

International Search Report (PCT/ISA/210) mailed on Mar. 1, 2013, by the European Patent Office as the International Searching Authority for International Application No. PCT/EP2012/061352.
(Continued)

*Primary Examiner* — Hoon Song
(74) *Attorney, Agent, or Firm* — Buchanan Ingersoll & Rooney P.C.

(57) ABSTRACT

In an electron irradiation system, a gas-tight housing encloses a cathode region and an irradiation region, which communicate through at least an aperture. In the cathode region, there is arranged a high-voltage cathode for emitting an electron beam. In the irradiation region, there is an irradiation site arranged to accommodate a stationary or moving object to be irradiated. The migration of cathode-degrading debris is limited by means of an electric field designed to prevent positively charged particles from entering the cathode region via the aperture. The invention can be embodied with an axial electric field, which realizes an energy threshold, or a transversal field which deflects charged particles away from trajectories leading into the cathode region.

15 Claims, 4 Drawing Sheets

(51) Int. Cl.

| | |
|---|---|
| ***H01J 35/08*** | (2006.01) |
| ***G21K 1/08*** | (2006.01) |
| ***G21K 5/04*** | (2006.01) |
| ***H01J 35/14*** | (2006.01) |

(52) U.S. Cl.
CPC ..... *H01J 35/08* (2013.01); *H01J 35/14* (2013.01); *H01J 2235/082* (2013.01); *H01J 2235/16* (2013.01)

(56) References Cited

FOREIGN PATENT DOCUMENTS

| | | | |
|---|---|---|---|
| WO | WO 2010/083854 | A1 | 7/2010 |
| WO | WO 2010/112048 | A1 | 10/2010 |
| WO | WO 2012/072146 | A1 | 6/2012 |
| WO | WO 2012/087238 | A1 | 6/2012 |

OTHER PUBLICATIONS

D.H. Larson et al., A 24 keV Ilquld-metal-jet x-ray source for biomedical applications, Review of Scientific Instruments 82, 123101, vol. 82, No. 12, Melville, NY, US, Dec. 1, 2011, 5 pages.
Yoshiaki Arata et al., 100 kW Class Electron Beam Welding Technology (Report IV)—Fundamental Research on Horizontal Electron Beam Welding, Transactions of JWRI. 9(2), Dec. 1, 1980, pp. 157-166.

* cited by examiner

LIMITING MIGRATION OF TARGET MATERIAL

TECHNICAL FIELD

The invention disclosed herein generally relates to electron irradiation systems. In particular, it relates to an electron-impact X-ray source with a cathode protection arrangement.

TECHNICAL BACKGROUND

Systems for generating X rays by irradiating a liquid target are described in the applicant's International Applications PCT/EP2009/000481, PCT/EP2009/002464, PCT/EP2010/068843 and PCT/SE2011/051557. In these systems, which typically operate at very low pressures, an electron gun comprising a high-voltage cathode is utilized to produce an electron beam which impinges on the target. Free particles, including debris and vapour from the liquid target, tend to gradually degrade the cathode (e.g., by corrosion) and reduce its useful life. Similar problems associated with chemical cathode degradation have been noted in high-energy electron irradiation systems with cathodes operating at a high potential and/or high temperature.

SUMMARY

In view of the above shortcomings of available technology, it is an object of the present invention to propose a high-energy electron irradiation system with an increased cathode life. A particular object is to provide an electron-impact X-ray source with a reduced migration rate of target material to the cathode. A further particular object is to provide a liquid-jet X-ray source with a reduced migration rate of vaporized target material to the cathode.

Accordingly, the invention provides devices and methods for electron irradiation in accordance with the independent claims.

In an electron irradiation system, a gas-tight housing encloses a cathode region and an irradiation region, which regions communicate by virtue of one or more passages. The gas-tightness enables operation under low-pressure conditions, wherein there may be provided one or more outlets, through which the housing is evacuated, e.g., by pumping. In the cathode region, there is arranged a high-voltage cathode for emitting an electron beam. In the irradiation region, there is an irradiation site arranged to accommodate a stationary or moving object to be irradiated. The regions communicate inter alia via an aperture that encloses at least a segment of at least one possible electron trajectory from the cathode to the irradiation site. For the purposes of the invention, it is not important what structural element(s) delimit(s) the aperture or, for that matter, whether the aperture is delimited on all sides. The presence of accelerating electric or magnetic fields and possible further factors determine the locations of the electron trajectories. Because the cathode and the irradiation site may have a nonzero spatial extent, there may be a certain particle energy spread, and the accelerating fields may vary over time, there is typically a plurality of possible electron trajectories. While the aperture encloses one or more electron trajectory segments, it need not be centred on any of these.

The gas-tight housing comprises a first electrically conductive element, such as an assembly of metallic vacuum envelope parts. The gas-tight housing may be monolithic, consisting of a single conductive element, on which irradiation equipment and other equipment are mounted, e.g., a high-voltage cathode mounted on an isolator. Alternatively, the housing may further comprise non-conductive parts. In particular, the housing may consist of a plurality of mutually insulated conductive elements, allowing each insulated conductive element to be put on an electric potential independently of the other elements making up the housing.

According to a first aspect of the invention, the electron irradiation system further comprises at least one second electrically conductive element and an electric source operable to apply a nonzero bias voltage between the first and second conductive elements. The geometric configuration of the first and second conductive elements and the magnitude of the bias voltage are selected in order for the resulting electric field to prevent positively charged particles from entering the cathode region via the aperture.

The invention is based on the realization the percentage of the free cathode-degrading particles which are charged is surprisingly high. This indicates that electrostatic means may be efficient for the purpose of controlling (e.g., reversing, trapping or diverting) the transport of particles towards the cathode. Without acquiescing to a particular physical model, the inventors currently believe that ionization takes place in the vicinity of the electron beam, mainly upstream of the irradiation site, where the electron beam interacts with the irradiated object and vapour is produced. (As used in this disclosure, the terms "upstream" and "downstream" refer to the direction in which the electron beam propagates.)

The invention gives priority to electrostatic means rather than magnetic means, mainly because electrostatic fields influence charged particles independently of their energies. Conversely, because the electrons in the electron beam typically travel much faster than the charged particles, it will be a more delicate task to design a magnetic field which efficiently prevents debris transport towards the cathode but does still not disturb the electron beam to a significant extent.

It is known that conventional electron optical systems for focusing, aligning, deflecting etc. the electron beam may in some circumstances tend to push charged particles towards the optical axis of the system, that is, closer to the electron beam. In addition to this, as the inventors have noted, an electrostatic suction effect associated with the electron beam, which under some conditions attracts positively charged particles towards itself. The positively charged particles may behave similarly to charges in the vicinity of a stationary elongated negative charge. Because the aperture connecting the irradiation region to the cathode region is typically centred on the electron beam path, each of these two effects will increase the tendency of charged particles to "find" and enter the aperture in the upstream direction, to thereby reach the cathode region. Put differently, the two effects may be said to increase the acceptance angle of the aperture. Based on this, the inventors have realized that it is essential to prevent positively charged particles from entering the cathode region, since the charged particles will most likely interact with the intense acceleration field immediately downstream of the high-voltage cathode and collide with the cathode or other elements in the cathode region. The resulting high-speed collisions on the surfaces, in particular the cathode surface, may cause sputtering damage, which adds to the more widely known chemical corrosion already discussed. Finally, the inventors have realized that it is primarily important to prevent charged particles from entering through the aperture enclosing an electron trajectory or a line-of-sight towards the cathode. Indeed, charged debris particles will typically stick on (be adsorbed by) and/or neutralize on conductive wall elements, such as portions of an earthed vacuum envelope, which implies that curved or angled paths or paths partially interrupted by baffles are typically no important sources of particles that could be harmful to the cathode. The tendency to stick on a surface, which may be quantified as a sticking coefficient, is relatively high for most metallic particles impinging on metallic surfaces.

Because the acceleration of an electric field on a particle with charge q and mass m is proportional to the quotient q/m, theoretic considerations suggest that a population of charged particles with an unbounded velocity distribution may not be completely prevented from entering the cathode region via the aperture. However, the invention will have achieved at least one of its objects if there is a reduction in the quantity of target material that enters the cathode region. Considerations regarding the qualitative (geometry) and quantitative (strength) parameters of the electric field will be discussed in greater detail below.

It is noted that the second electrically conductive element may be a plurality of physically separate conductive elements which are separated from the first conductive element by a common bias voltage. Alternatively, the second conductive element may consist of a plurality of (groups of) electrically conductive elements, which are connected to independent (but not necessarily distinct) electric potentials, so that they are separated by a plurality of independent bias voltages from the first conductive element.

In a second aspect, the invention provides a method for irradiating an object in an irradiation site located in an irradiation region, which is enclosed in a gas-tight housing at least partially consisting of a first conductive element. The method comprises the following steps, which are typically overlapping in time:

- An electron beam is emitted from a high-voltage cathode arranged in a cathode region enclosed in the same gas-tight housing as the irradiation region and communicates with the latter.
- The electron beam is directed through an aperture, which connects the cathode region and the irradiation region.
- An electric field is generated by means of a second conductive element on a different electric potential than the first conductive element. The electric field prevents positively charged particles in the irradiation region from passing through the aperture into the cathode region.

In the irradiation region, the electron irradiation will produce debris (e.g., vapour). For reasons of ionization, as the inventors have realized, that portion of the debris which travels in the upstream direction, toward the aperture, contains an unexpected percentage of charged material. This aspect of the invention may also efficiently reduce the amount of charged particles, whichever their origin may be, that enters the cathode region via the aperture.

Advantageous embodiments of the invention are defined by the dependent claims and will now be briefly discussed. A first group of embodiments relates to irradiation systems in which the transport of positively charged particles is controlled or reduced by means of an electric field with an orientation substantially parallel to the electron beam. An electric field may preferably be generated by means of a rotationally symmetric electrode. With this setup, the electric field will disturb the electron beam to a limited extent or in a way that can be easily compensated for by defocusing or refocusing. In particular, the primary effect of a rotationally symmetric electrode is to change the divergence of the electron beam. A second group of embodiments utilize an electric field with a transversal component, which deflects charged particles away from such trajectories that lead up to the cathode or a point in the strong acceleration field associated with the high-voltage cathode. A further group of embodiments can be used with an arbitrary orientation of the electric field.

In an embodiment, the second conductive element is insulated from the first conductive element and delimits the irradiation region from the cathode region by partially sheltering the cathode or cathode region from the irradiation site. This is an advantageous geometry for producing an electric field extending parallel to the electron beam. The second conductive element may be a solid delimiter, extending up to the housing and leaving the aperture as the only passage between the cathode region and the irradiation region. Alternatively, the second conductive element may be partially or completely detached from the housing or may be perforated in itself, so that more than one passage between the cathode region and the irradiation region exist. The second conductive element may limit the aperture in such manner that it defines at least a segment of the boundary of the aperture. In particular, the aperture (or at least an axial segment thereof) is entirely defined by the second conductive element. The second conductive element may therefore be said to surround a portion of the aperture. Alternatively, the second conductive element is arranged in the vicinity of the aperture but at a nonzero distance from the aperture. Preferably, if the second conductive element is arranged at or in the vicinity of the aperture, it is repulsive.

A second conductive element that surrounds the aperture may act as a virtual anode to be put on a different electric potential than the high-voltage cathode, that is, it will be weakly positive with respect to ground potential. An accelerating electric field will be localized in the acceleration gap between the cathode and the virtual anode. In use, it accelerates electrons in the downstream direction in a substantially symmetric fashion as seen in cross section. This implies that a large share of the electrons emitted from the cathode will centre on a trajectory entering the aperture in the virtual anode. The electrons accelerated in this manner will then proceed downstream of the virtual anode at high speed.

As will be discussed in greater detail in the next section, the bias voltage to be applied to generate a parallel electric field is to be selected in such manner the act of moving a singly charged positive ion with a kinetic energy below a maximum energy from the irradiation site through the electric field to the aperture requires a work greater than said maximum energy. In other words, the parallel electric field is designed such that it realizes an energy threshold high enough to stop all ions with kinetic energies below the maximum energy.

In an embodiment, the second conductive element is arranged inside the aperture. It may as well be arranged in the irradiation region, which is located downstream of the aperture and downstream of any further passages through which the irradiation region communicates with the cathode region. As discussed above, ionization of vapour occurs throughout the extent of the electron beam. Hence, if the second conductive element may be arranged at a plurality of possible positions at different axial coordinates, it may be preferable to choose the position located the furthest upstream; this limits the share of charged particles that is produced upstream of the second conductive element. These particles are otherwise relatively more difficult to control.

A second conductive element arranged inside the aperture or in the irradiation region is preferably utilized to generate an electric field oriented transversally with respect to the electron beam. In configurations where the lines of the electric field are curved—such a field may arise in a neighbourhood of an annular conducting element—the field may be considered to be oriented transversally if this is the direction of the field in its most concentrated region, in which a charged particle will undergo significant acceleration. Further, an electric field which exerts a transversal force (or a force with a nonzero transversal component) on charged particles in the vicinity of the electron beam may also be considered transversally oriented; the action of the electric field on particles located elsewhere will be of secondary importance, if any, on the prevention of charged particles' entering the cathode region.

In an embodiment, the second conductive element is an attractive element arranged in the vicinity of the aperture. The second conductive element may comprise a passage. In particular, the second conductive element may be a ring-shaped element with a larger diameter than the aperture and enclosing an electron trajectory (trajectories) which is (are) also enclosed by the aperture; in particular, the aperture and the ring-shaped element may be co-axial. If a weak negative potential is applied to the ring-shaped element, it will attract positively charged particles approaching the aperture from inside the irradiation region and deflect them away from paths going into the aperture. The magnitude of the negative potential is limited by an upper threshold, so that the ring-shaped element has the character of an attractive ring, which accelerates nearby particles in the radial direction, rather than a virtual attractive electrode, which accelerates the particles parallel to the electron beam and then allows these to continue through the passage towards the aperture.

In a further development of the previous embodiment, the attractive second conductive element is connected in series with an ammeter or similar current measuring device. The measured current is related to the momentary drain of electric charge away from the second conductive element. Hence, it is also related to the production rate of charged debris.

As an alternative to the previous embodiment, the second conductive element is adapted to produce a deflection field oriented transversally (with respect to the electron trajectory which is enclosed by the aperture). A second conductive element adapted for this purpose may be located in the irradiation region or inside the aperture. The second conductive element may be attractive or repulsive. It may further be arranged in conjunction with a third conductive element, wherein a deflection field is localized (or concentrated) between the second and third conductive elements. The term "localized" does not imply that the electric deflection field vanishes outside a region of spaced located between the second and third conductive elements. With this configuration, there may be one attractive and one repulsive element. The plate-shaped elements may be oriented parallel to the electron beam or to the electron trajectory enclosed by the aperture, and may further be parallel to one another. With such a configuration, the resulting field (excluding boundary portions of the field) will accelerate a charged particle substantially in the direction of the attractive plate.

In an embodiment, there are at least one second conductive element on above-ground potential (which repels positively charged particles) and at least one third conductive element on below-ground potential (which attracts positively charged particles). The elements need not be arranged in a pairwise fashion. If a pair is formed from an attractive and a repulsive element, the resulting field is not necessarily a deflection field oriented transversally to an electron trajectory. Indeed, each of the second and third conductive elements may have any suitable shape and the totality of the elements may be arranged in any spatial configuration suitable to prevent charged particles from entering the cathode region via the aperture.

It is presently intended to use the electron irradiation system of the first aspect in conjunction with an electron-impact X-ray source. In addition to the electron irradiation system, an X-ray source may comprise an electron target, on which the electron beam impinges in the irradiation site to produce X rays, and a window allowing X rays to leave the housing. The electron target may be a stationary or mobile object. In particular, the target may be a jet of liquid material, especially molten metal (e.g., Ga, and other metals or alloys with low melting points). The X-ray window may exhibit the one or more of the features disclosed in applications PCT/EP2009/000481 and PCT/EP2010/068843.

BRIEF DESCRIPTION OF THE DRAWINGS

Embodiments of the invention will now be described with reference to the accompanying drawings, on which.

The drawings are not necessarily to scale. Unless otherwise indicated, like reference numbers indicate like elements in different figures. The drawings may show only such elements or details that are necessary to elucidate concepts of the present invention, while other elements and details may have been omitted for the sake of clarity.

DETAILED DESCRIPTION OF EMBODIMENTS

Figure 1:
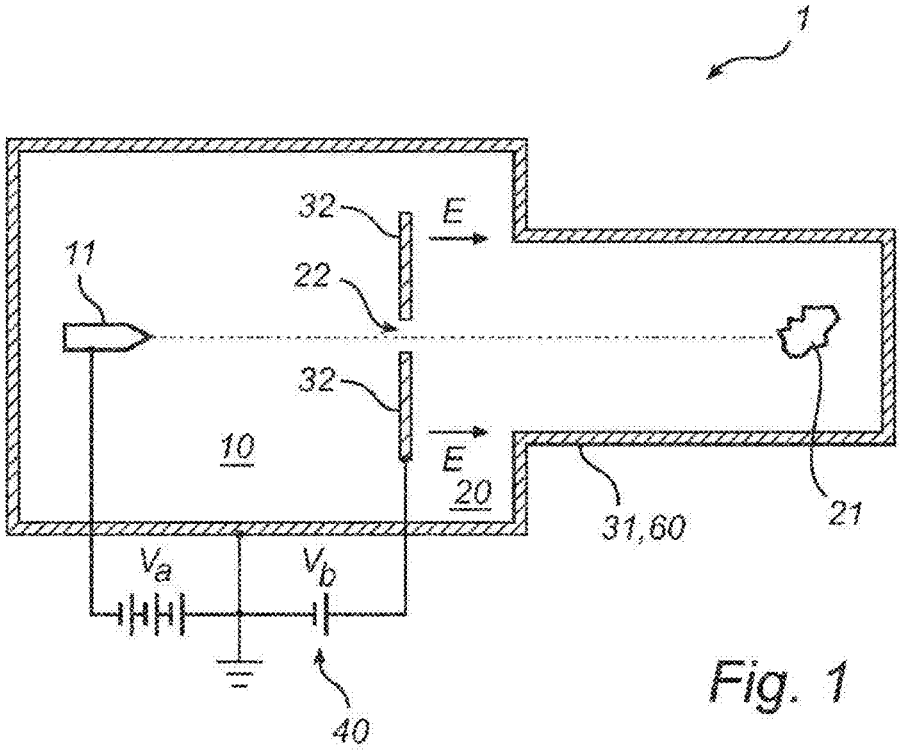
FIG. 1 is a cross section view of an electron irradiation system, in which a parallel electric field controls the migration of debris particles into the cathode region.

FIG. 1 shows an electron irradiation system 1 configured to produce an electron beam irradiating an object located in an irradiation site 21 in the right-hand portion of the system. The electron beam is produced by a high-voltage cathode 11 in an electron gun located in the left-hand portion of the system, which is connected to an acceleration voltage $V_a$. The acceleration voltage may be of the order of tens of kilovolts or hundreds of kilovolts. These parts are contained in a gas-tight housing 60, which can be evacuated to allow the electron beam generation, propagation and irradiation to take place in vacuum or quasi-vacuum conditions, such as between $10^{-9}$ and $10^{-6}$ bar. In this embodiment, the gas-tight housing 60 is formed as a first conductive element 31, which is electrically connected to ground potential. The first conductive element 31 may consist of a plurality of subparts which are combined in an electrically conductive fashion. A second conductive element 32, which is substantially plate-shaped and comprises a central aperture 22, is arranged at a position where the aperture 22 encloses a segment of an electron trajectory, indicated by a horizontal broken line, from the cathode 11 to the irradiation site 21. The second conductive element 32 is located at an axial position, upstream of which a cathode region 10 is located and downstream of which an irradiation region 20 is located. Because the second conductive element 32 is detached from the housing 60, at least in the plane of the drawing, the cathode region 10 and the irradiation region 20 are in fluid communication, which simplifies the task of achieving vacuum conditions using one single evacuation outlet. Hence, both the cathode 11 and the irradiation site 21 may be contained in a common chamber under vacuum during operation of the system 1. Because the regions communicate, any significant pressure differences will typically even out spontaneously, so that the regions 10, 20 are at substantially equal pressures. (This does not necessarily apply to pressure differences arising as an effect of localized pumping, leakage, heating and the like, which may have a steady-state character.)

In this embodiment, the second conductive element 32 extends so far in the transversal direction that it covers all straight lines from the irradiation site 21 to the cathode region 10, so that any particles moving along straight lines are required to enter into contact with the housing 60 or the second conducting element 32 when attempting to reach the cathode region 10. In the case of charged particles or metal droplets, such contact will likely imply an immobilization of the particles, by neutralization and/or sticking. The only rectilinear paths from the irradiation site 21 into the cathode region 10 pass through the aperture 22. In other words, the second conductive element 32 partially shelters the cathode region 10 from the irradiation site 21.

In the depicted system 1, a further important mechanism counteracting the migration of debris into the cathode region 10 is the fact that a voltage source 40 applies a weak positive potential $V_b$ to the second conductive element 32. As a consequence, positively charged particles in those portions of the irradiation region 20 that are close to the second conductive element 32 will be repelled from the second conductive element 32, hence away from the aperture, by an electric field E oriented substantially parallel to the electron trajectory. The repulsive electric field will realize a threshold in terms of potential electrostatic energy that will stop all charged particles except those with the highest kinetic energies, which are capable to lift themselves over the threshold and enter the aperture 22. Particles with lower energies will be confined in a downstream portion of the irradiation region 20, where the potential electrostatic energy is relatively lower. When confined in this manner, the particles have a significant likelihood to collide with an object in the irradiation region 20, primarily the housing 60, thereby terminating their life as mobile particles. It is noted that the positive potential applied to the second conductive element 32 is relatively weak, so that a strong acceleration field is present between the cathode 11 and the second conductive element 32. In this configuration, the second conductive element 32 may be said to function as a virtual anode, which allows accelerated electrons to pass through the aperture 22 in the downstream direction.

Figure 2:
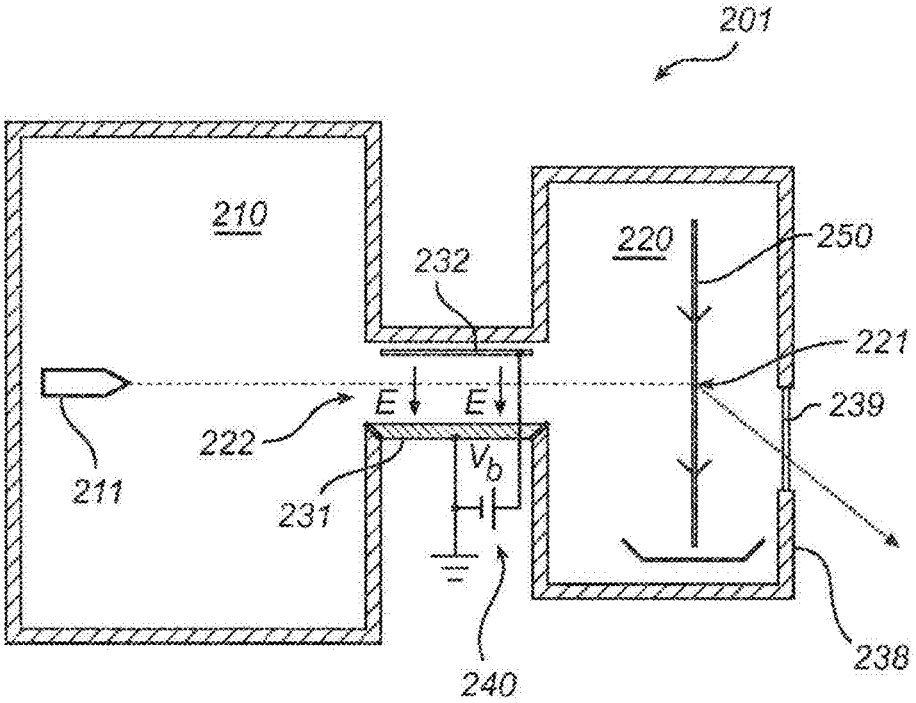
FIG. 2 is a cross section view of an electron irradiation system included in a liquid-jet X-ray source, in which a transversal deflection field controls the migration of debris particles into the cathode region.

FIG. 2 shows an electron irradiation system 201, which is arranged in conjunction with equipment for producing a jet 250 of liquid material, preferably by circulating the target material in a closed or semi-closed loop. The jet passes through the irradiation region 221, where it intersects an electron beam (broken horizontal line) that is generated by a cathode 211. The electron beam interacts with the flow of liquid material to generate a beam of X rays, which leaves the housing through an X-ray window 239. The geometry of the housing 260 differs from the one shown in FIG. 1 in that the volume enclosed by the housing 260 consists of the cathode region 210, the irradiation region 220 and the aperture 222, which is the only passage through which the regions 210, 220 communicate.

In this embodiment, a transversal electric field E is concentrated between a first conductive element 231, which is integrated in the housing and delimits a portion of the aperture 222, and a second conductive element 232 arranged inside the aperture 222. The remainder 238 (/-sloping hatching) of the housing is electrically insulated from the first conductive element. The remainder 238 is preferably but not necessarily maintained at constant potential, so that electric charge is not allowed to accumulate; for instance, the remainder 238 may be connected to ground potential. With the particular polarity of the voltage source 240 that is shown in FIG. 2, the second conductive element 232 repels positively charged particles in the aperture 222, which are likely to collide and neutralize on the surface of the first conductive element 231, which is attractive. With the possible exception of particles which carry much kinetic energy and/or are weakly charged, the transverse deflection field may prevent particles from completing their traversal of the aperture 222, so that they will not reach the cathode region 210. In a variation to this embodiment, the polarity of the voltage source 240 may be reversed without any significant effect on the ability of the field to prevent entry of charged particles into the cathode region 210 through the aperture 222.

Figure 3:
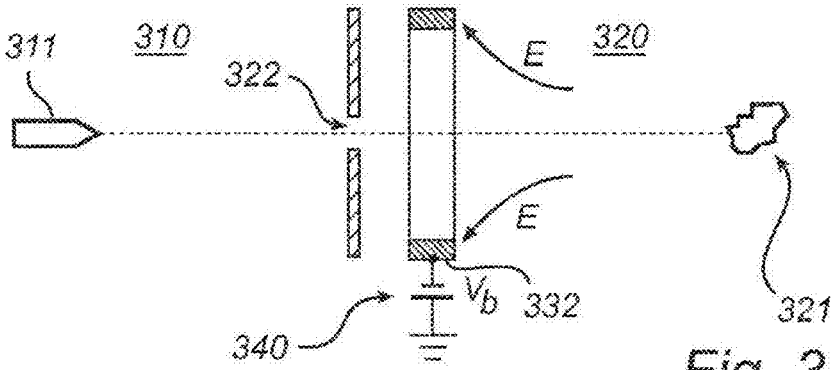
FIG. 3 is a cross section view along the main optical axis of an electron irradiation system, in which a ring-shaped attractive element limits the penetration of debris into an aperture leading to the cathode region by generating an electric deflection field with a significant transversal component, which accelerates charged particles away from the aperture.

FIG. 3 shows details of a central segment of an electron beam path (horizontal broken line) in an electron irradiation system. For the sake of clarity, FIG. 3 has not been drawn to scale, but rather the cathode 311 and the irradiation site 321 are more distant than FIG. 3 suggests in a realistic design. An element extending in the transversal directions (vertically in FIG. 3) comprises an aperture 322, which encloses the electron beam that is produced during operation of the cathode 311. The details shown in FIG. 3 are enclosed in a housing formed of a first conductive element (not shown) connected to ground potential. To prevent positively charged particles in the irradiation region 320 from entering the cathode region 310 through the aperture 322, there is provided a second conductive element 332, to which an attractive electric potential is applied. As seen from the downstream direction, the second conductive element 332 surrounds the aperture 322 from some distance outside its edge. The second conductive element 332 may have a shape substantially similar to that of the cross section of the aperture 322 (e.g., circular, square) but need not follow the edge of the aperture 322. The second conductive element 332 and the first conductive element (not shown) generate an electric field E located in the neighbourhood of the aperture 322 when the second conductive element 332 is connected to nonzero potential. The second conductive element 332 may be designed with the aim that the electric field has a nonzero outward radial component in the largest possible percentage of the neighbourhood of the aperture 322. Put differently, the electric field generated by the first and second conductive elements 332 acts to remove charged particles from the aperture 322 if the charged particles are close to the aperture 322.

The attractive potential is applied to the second conductive element 232 by means of a voltage source 340. The high-potential end of the voltage source 340 may be connected to ground potential. In a variation to this embodiment, an ammeter (not shown) is connected in series with the voltage source 340, e.g., between the second conductive element 332 and the voltage source 340. This enables measurements or estimations of the quantity of charged debris depositing on the second conductive element 232 per unit time.

It has been discussed previously that a ring-shaped conductive element is seen as a point charge by a remote particle located on or near its symmetry axis. Ring-shaped elements may therefore act as virtual anodes for the purpose of accelerating an electron beam or the like. It is not desirable for the second conductive element 332 in the FIG. 3 to accelerate charged particles into the aperture 322. To limit the number of charged particles accelerated in this manner, the potential applied to the second conductive element 332 should not be chosen higher than necessary; preferably, the lowest electric potential that provides the desired reduction in particles entries into the cathode region 310 is chosen. The tendency to accelerate charged particles into the aperture 322 will further decrease when the diameter of the second conductive element 332 increases. It may also be advantageous to ensure that the second conductive element 332 is well centred on the electron beam location, where apparently few charged particles will be located. From other positions than the centre line through the second conductive element 332, the electric field will exert an outward acceleration component on a charged particle, away from trajectories leading into the aperture 322.

It is noted that the embodiments disclosed in FIGS. 1 and 3 may be combined to advantage. The resulting arrangement would comprise a repulsive element located close to or around the aperture and an attractive element located slightly further away and having larger diameter. By absorbing nearby particles, the attractive element would reduce the concentration of charged debris in the area downstream of the aperture. The repulsive element would act as a safeguard against those charged particles that are anyway present in this area, namely by reducing the likelihood for them to pass through the aperture and enter the cathode region. Further, an ammeter connected to the attractive element in the manner outlined above will provide powerful diagnostic data. Indeed, the momentary thermal load in the interaction region can be monitored via the debris production rate in the system (as indicated by the ammeter current), which provides for accurate control of the electron-optical system. In particular, periods of thermal overload can be avoided, so that the reliability and useful life duration of the system are increased.

Figure 4:
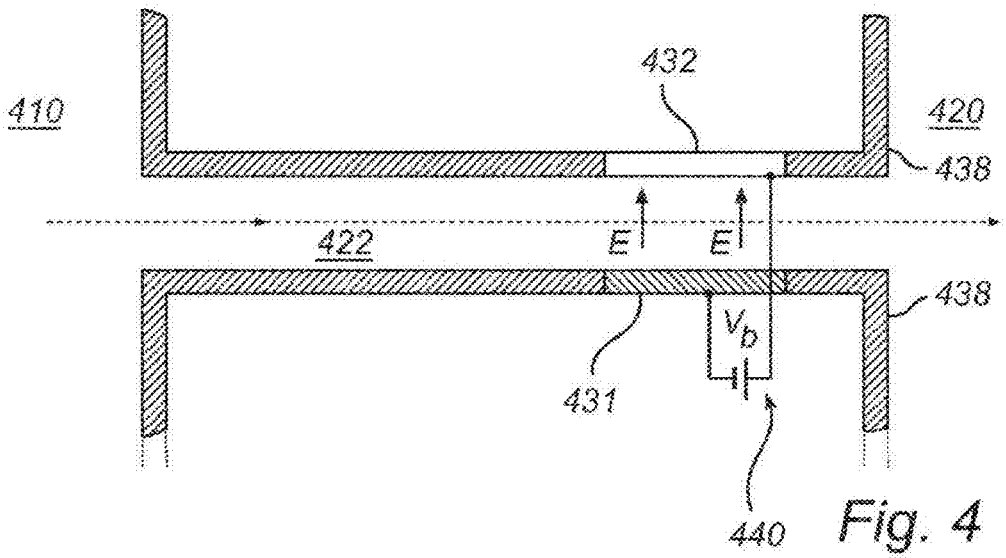
FIGS. 4 and 5 show, in a fashion similar to FIG. 3, details of an electron irradiation system, in which transversal deflection fields are utilized to divert charged particles from trajectories leading into the cathode region, wherein FIG. 4 refers to an embodiment where the deflection field is generated by conductive elements integrated in the housing surrounding the aperture, and FIG. 5 refers to an embodiment where the field is created by means of dedicated plates oriented parallel to the path occupied by the electron beam.

FIG. 4 is a cross section view of a central portion of an electron irradiation system, in which a cathode region 410 communicates with an irradiation region 420 via an aperture 422, which may have circular, rectangular, oval or some other cross section shape. The aperture is delimited by portions of a housing enclosing the electron irradiation system, namely a first conductive element 431, a second conductive element 432 and a remainder 438 of the housing. The first and second conductive elements 431, 432 are electrically insulated and are arranged opposite one another. In particular, they may be separated by portions of the remainder 438, as is not visible in the cross section view of FIG. 4. A vertically oriented deflection field E will form mainly in the interspace between the first and second conductive elements 431, 432 when a voltage source 440 applies an electric bias voltage $V_b$ between the elements. With a suitably tuned bias voltage, the electric field will prevent all or most charged particles from completing the upstream journey through the aperture 422.

Figure 5:
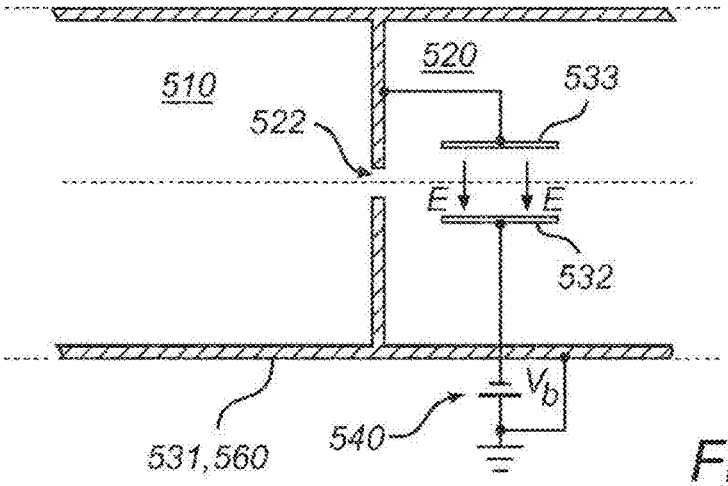

FIG. 5 shows a detail of an electron irradiation system having arrangements for reducing cathode degradation that functions in a manner similar to the system in FIG. 4. Differences between the systems in FIGS. 4 and 5 include: the aperture 522 is shorter; the portion of the housing 560 that is located in the vicinity of the aperture 522 consists of a first conductive element 531 on ground potential; a transversal deflection field E is oriented downwardly and is generated by two conductive plates 532, 533 extending parallel to the electron beam path (broken horizontal line) and perpendicular to the plane of the drawing. The conductive plates 532, 533 are not integrated in the housing 560, but the upper plate is in electric contact with the housing. Without any foreseeable inconvenience, it would be possible to let the upper plate extend up to the housing 560, which is anyway on equal electric potential. The lower plate 532 is connected to a weak negative potential—$|V_b|$ provided by a voltage source 540, which causes it to attract positively charged particles. The electric field E primarily attracts charged particles that are located in the interspace between the plates 532, 533 or in their vicinity. It will therefore effectively prevent charged particles from entering the aperture 522 and thereby contaminating the cathode region 510.

FIGS. 2 and 5 illustrate systems where the aperture 222, 522 which encloses the electron trajectory is the only passage between the cathode region 210, 510 and the irradiation region 220, 520. If the cross section area of the aperture 222, 522 is small, it may be advisable to provide more than one evacuation outlet (not shown), to which one or more vacuum pumps may be connected. The problem is less pronounced in more roomy layouts, such as the one shown in FIG. 1. An alternative way of facilitating vacuum pumping is to provide a bypass channel which connects the irradiation region and the cathode region preferably along a curved path or a path interrupted by baffles, so that particles are unable to travel in a rectilinear fashion into the cathode region.

Figure 6:
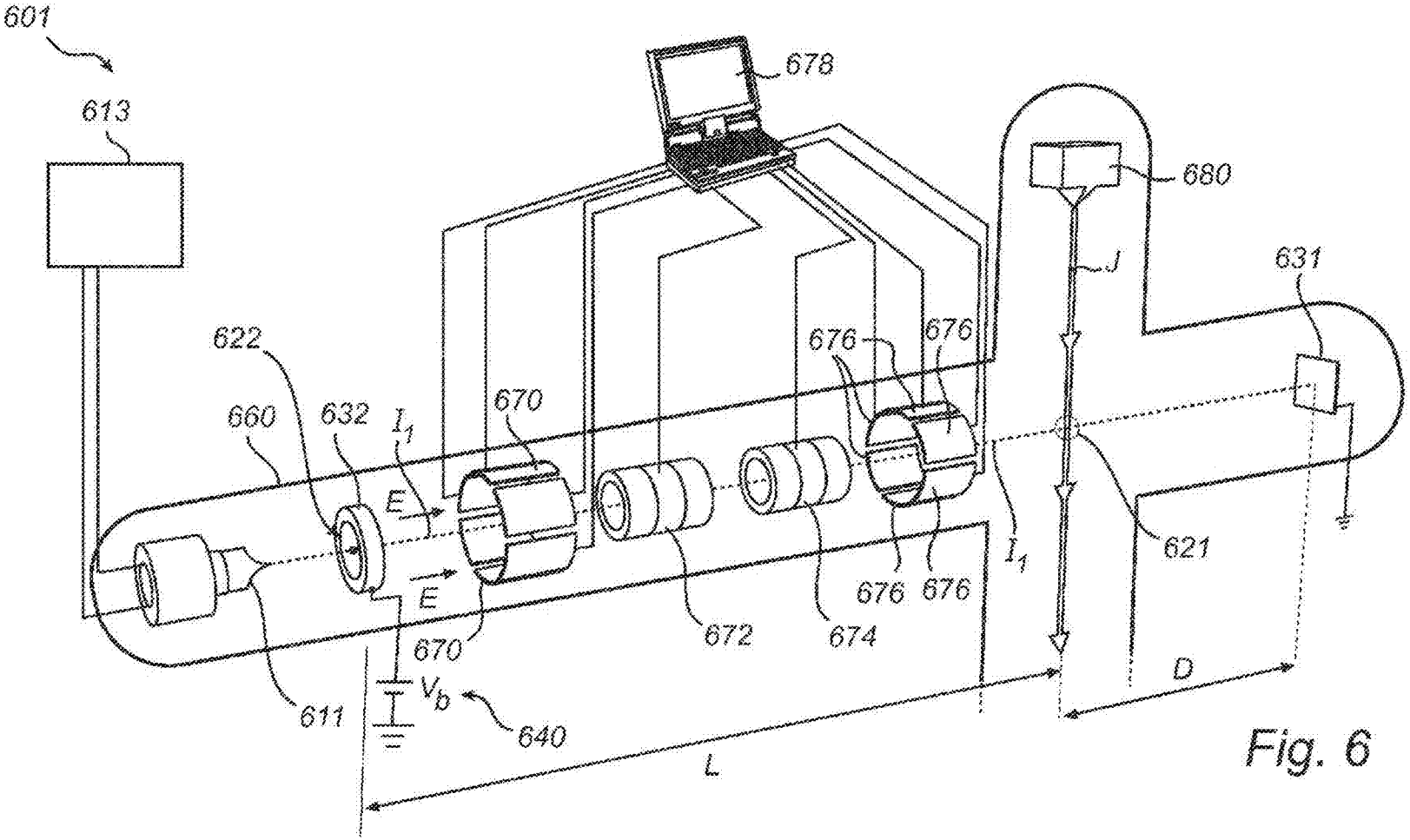
FIG. 6 is a cutaway perspective view of a liquid-jet X-ray source having means for generating a parallel electric field preventing debris from reaching the cathode.

FIG. 6 is a more detailed view of an X-ray source 601 including an electron gun 611, 613, 632, 670, 672, 674, 676, 678 for generating an electron beam $I_1$, means 680 for generating a liquid jet J acting as electron target, and a charge-drain plate 631, on which that portion of the electron beam $I_1$ which continued past the liquid jet J at the irradiation point 621 will impinge. The equipment is located inside a gas-tight housing 660, which possible exceptions for a voltage supply 613 and a controller 678, which may be located outside the housing 660, as shown in the drawing. Various electron-optical components functioning by electromagnetic interaction may also be located outside the housing 660 if the housing 660 does not screen electromagnetic fields to any significant extent. Accordingly, such electron-optical components may be located outside the vacuum region if the housing 660 is made of a material with low magnetic permeability, e.g., austenitic stainless steel. In this embodiment, the housing 660 is electrically conductive and acts as first conductive element in the sense of the appended claims. The electron gun generally comprises a cathode 611 which is powered by the voltage supply 613 and includes an electron source, e.g., a thermionic, thermal-field or cold-field electron source. Typically, the electron energy may range from about 5 keV to about 500 keV. An electron beam from the source is accelerated towards a second conducting element 632, in which an aperture 622 is defined. At this point, the electron beam enters an electron-optical system comprising an arrangement of aligning plates 670, lenses 672, 674 and an arrangement of deflection plates 676. Variable properties of the aligning means, deflection means and lenses are controllable by signals provided from a controller 678. In this embodiment, the deflection and aligning means are operable to accelerate the electron beam in at least two transversal directions. After initial calibration, the aligning means 670 are typically maintained at a constant setting throughout a work cycle of the X-ray source, while the deflection means 776 are used for dynamically scanning or adjusting an electron spot location during use of the source 601. Controllable properties of the lenses 672, 674 include their respective focusing powers (focal lengths). Although the drawing symbolically depicts the aligning, focusing and deflecting means in a way to suggest that they are of the electrostatic type, the invention may equally well be embodied by using electromagnetic equipment or a mixture of electrostatic and electromagnetic electron-optical components.

Downstream of the electron-optical system, the electron beam $I_1$ intersects with the liquid jet J, which may be produced by enabling a high-pressure nozzle 680, in an irradiation site 621, which acts as an interaction region. This is where the X-ray production takes place. X rays may be extracted from the housing 660 in a direction not coinciding with the electron beam, preferably through a dedicated window. The portion of the electron beam $I_1$ that continues past the irradiation site 621 reaches a charge-drain plate 631. A lower portion of the housing 660, a vacuum pump or similar means for evacuating air molecules from the housing 660, receptacles and pumps for collecting and recirculating the liquid jet J, quadrupoles and other means for controlling astigmatism of the beam have been intentionally omitted from this drawing to increase its clarity.

The interaction between the electron beam $I_1$ and the liquid jet J is known to produce both splashes and free particles containing amounts of the liquid target material. As noted, the inventors have realized that a significant amount of ionized debris is produced, including ions $Ga^+$, $Ga^{++}$ and $Ga^{+++}$ when a gallium jet is used. This is why the invention proposes electrostatic means for the purpose of limiting migration of the debris up to the cathode 611. In the embodiment shown in FIG. 6, an electric field E oriented substantially parallel to the electron beam $I_1$ is generated by applying a weak positive potential from about 10 V to 500 V, preferably 50 to 100 V, to the second conductive element 632, which is located at an axial distance L from the irradiation site 621. As already explained, the electric field E will confine charged particles to a region downstream of the second conductive element 632. In fact, the region to which the particles are confined can be separated further away from the second conductive element 632 (for a given range of kinetic particle energies) by increasing the bias voltage $V_b$ applied to the second conductive element 632.

In a simulated example, ions $Ga^+$, $Ga^{++}$ and $Ga^{+++}$ were produced with Maxwell-Boltzmann-distributed kinetic energies. At T=2000 K, the most probable ion energy $k_B \times T$ was approximately 0.17 eV. No repulsion at the second conductive element 632 was observed when this was put on ground potential. It was observed that thermal ions were repelled from the second conductive element 632 already when a bias voltage $V_b$ of a couple of volts was applied. With a higher bias voltage, ions were repelled earlier: when the second conductive element 632 was put on +50 V potential, no ions came closer than 10.4 mm; a +500 V potential was able to maintain a headroom of about 14.9 mm.

The following remarks can made with regard to the suitable range for the bias voltage and consequently, the suitable strength of the electric field. An electric field that is parallel with the electron beam may tend to accelerate electrons to some extent in the outward radial direction. While the focus of the electron beam can typically be restored using correction lenses and the like, a parallel field may also introduce irreversible aberrations. In a use case, this may be a reason to minimize the strength of an anti-parallel electric field.

Figure 7:
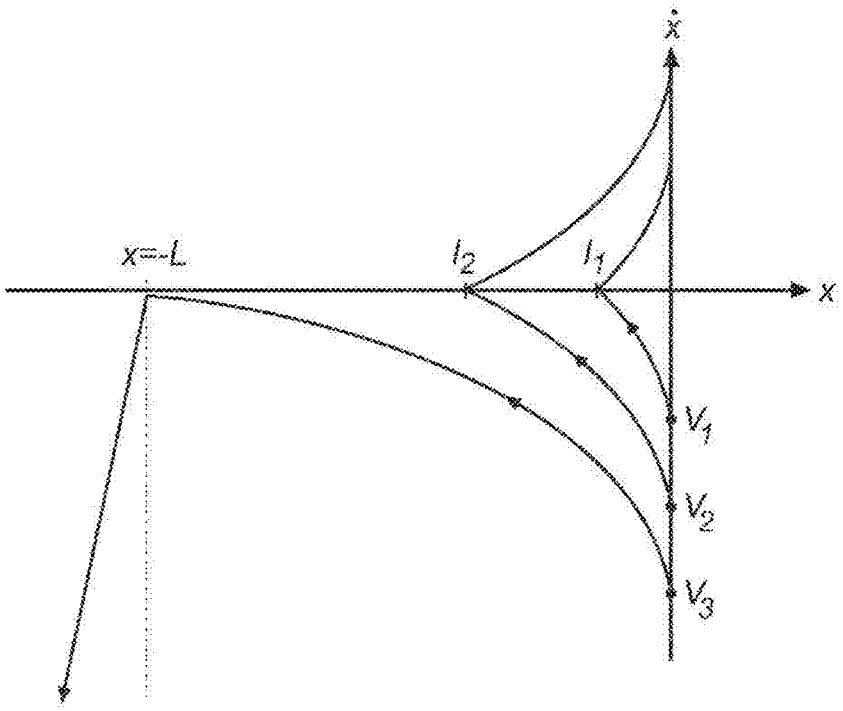
FIG. 7 is a phase-space diagram showing the axial positions and velocities of three particles released from the irradiation site at different initial speeds.

FIG. 7 is a phase-space diagram intended as a guideline for dimensioning the bias voltage in a situation where an electric field extends parallel to the main axis of an electron irradiation system. The horizontal axis indicates the axial position along the main axis, where coordinate x=0 corresponds to the irradiation site and x=−L corresponds to the position of the aperture. The vertical axis indicates $\dot{\chi}$, the signed axial component of the velocity vector. In the diagram, there are three curves representing phase-space positions occupied by three charged particles travelling upstream at different initial velocities $v_3<v_2<v_1<0$ from the position x=0. Assuming motion in the x direction only, the two slower particles will reach positions $x=I_1$ and $x=I_2<I_1<0$ before they return towards the irradiation site. Assuming three-dimensional motion, the particles are free to move anywhere to the right of their respective curves (implying inter alia that the particle with initial velocity $v_2$ may occupy the point $(\chi, \dot{\chi})=(0,l_1)$), so that coordinates $x=I_1$ and $x=I_2$ represent the points furthest upstream that the particles may reach. Turning to the faster particle, which leaves the irradiation region x=0 at velocity $v_3$, this particle carries sufficient energy to reach the aperture at x=−L. The strong acceleration field associated with the high-voltage cathode occupies the region x<−L, which implies that the particle will undergo powerful acceleration in the negative x direction towards the cathode and will enter the cathode region at increasing speed.

As FIG. 7 illustrates in simplified form, a parallel electric field will prevent particles up to a certain kinetic energy from entering the cathode region, but will let faster particles pass. The design criterion may be formulated: the bias voltage is selected in such manner that displacement of a singly charged positive ion from the irradiation site through the electric field to the aperture requires a work greater than said maximum energy. At least partial information on the velocity distribution is typically available in a realistic use case, e.g., the average energy, the share of particles which are faster than a specific threshold velocity. It is known per se in the art how to derive such information from macroscopic quantities, such as the electron beam energy distribution, temperature of the irradiation site etc. It is believed that the person skilled in the art will be able to use such information to determine a suitable bias voltage, e.g., one that generates an electric field sufficient to prevent at least 99% of the charged particles produced at the irradiation site from entering the aperture. In the context of FIG. 7, at most 1% of the particles will be as fast as or faster than the particle with initial velocity $v_3$ and hence capable of leaving the irradiation region. As an alternative to this approach, the skilled person may resort to routine experimentation including measurements enabling to estimate the rate of cathode degradation for a selection of bias voltage values.

The considerations are different in embodiments where a transversal electric field is utilized. Firstly, a perpendicular electric field may influence the electron beam in a way that is typically easier to correct; indeed, the influence mainly consists in a deflection from the undisturbed trajectory, and effects like defocusing and aberration will typically be less pronounced. The transversal impulse exerted by a deflection field is related to the charged particle's dwell time in (or passage time through) the field. First, this fact is advantageous in that the high-energy electrons travel at significantly higher speeds than the charged particles produced in the irradiation region, so that the transversal deflection will disturb the electron beam to a very small extent in normal operation of the electron irradiation system. Second, in order for a deflection field to be able to accelerate charged particles away from a path into the aperture (and preferably to capture them by collisions against a conductive wall), the strength of the deflection field and the speed of the charged particles are in an inverse relationship. That is, a stronger field is required to capture faster charged particles. The computation is straightforward with access to known, estimated or assumed values of the following parameters: minimum expected charge-to-mass (q/m) quotient, maximum velocity and required total transversal acceleration.

The person skilled in the art realizes that the present invention by no means is limited to the example embodiments described above. On the contrary, many modifications and variations are possible within the scope of the appended claims. For example, the first and second conductive elements may be arranged in other geometric positions. The resulting electric field need not be purely axial or purely transversal, but may be oriented in different ways provided it is effective in limiting the mobility of debris particles, notably by accelerating them away from the aperture or immobilizing them by electric neutralization or adsorption onto a surface. In particular, time-varying electric fields may be realized, which provides for more sophisticated ways of diverting debris particles from unsafe regions (e.g., the vicinity of the aperture) into regions where they are harmless. Time-varying electric fields may also be used to clear the irradiation region from freely moving debris more thoroughly at periodic intervals.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage.

The invention claimed is:

1. An electron irradiation system comprising:

a first conductive element;

a gas-tight housing comprising said first conductive element which is electrically connected to at least a portion of the housing, the housing enclosing a cathode region and an irradiation region communicating with the cathode region;

a high-voltage cathode, which is arranged in the cathode region and operable to emit an electron beam;

an irradiation site, which is arranged in the irradiation region;

an aperture connecting the cathode region and the irradiation region and enclosing an electron trajectory from the cathode to the irradiation site, and a second conductive element and a voltage source for applying a nonzero bias voltage between the first and second conductive elements, for thereby generating an electric field (E) which prevents positively charged particles from entering the cathode region via the aperture.

2. The system of claim 1, wherein the second conductive element is insulated from the first conductive element and delimits the irradiation region from the cathode region by partially sheltering the cathode region from the irradiation site.

3. The system of claim 2, wherein the second conductive element is arranged in vicinity of the aperture and is repulsive with respect to the positively charged particles.

4. The system of claim 3, wherein the second conductive element is a virtual anode surrounding the aperture.

5. The system of claim 3, wherein, in order to trap positive ions being produced in the irradiation site and having a kinetic energy below a maximum energy ($W_K$), the bias voltage is selected in such manner that displacement of a singly charged positive ion from the irradiation site through the electric field to the aperture requires a work greater than said maximum energy.

6. The system of claim 1, wherein the second conductive element is arranged inside the aperture or in the irradiation region.

7. The system of claim 6, further comprising an ammeter arranged in series with the second conductive element, which is attractive with respect to the positively charged particles.

8. The system of claim 6, wherein the second conductive element is attractive with respect to the positively charged particles, is arranged in vicinity of the aperture and comprises a passage which encloses said electron trajectory enclosed by the aperture.

9. The system of claim 6, wherein the second conductive element is adapted to produce a deflection field oriented transversally to said electron trajectory enclosed by the aperture.

10. The system of claim 9, further comprising a third conductive element, wherein the deflection field is localized between the second and third conductive elements.

11. The system of claim 10, wherein the second and third conductive elements are conductive plates extending parallel to said electron trajectory enclosed by the aperture.

12. An X-ray source comprising:

the electron irradiation system of claim 1;

an electron target, on which the electron beam is focused and with which the electron beam interacts in the irradiation site to produce X rays; and a window allowing X rays to leave the housing.

13. A method for irradiating an object in an irradiation site in an irradiation region enclosed in a gas-tight housing comprising a first conductive element being electrically connected to at least a portion of the housing, the method comprising:

emitting an electron beam using a high-voltage cathode in a cathode region, which is enclosed in the housing and communicates with the irradiation region; and directing the electron beam through an aperture towards the object in the irradiation site, said aperture connecting the cathode region and the irradiation region, whereby positively charged particles are produced in the irradiation region, generating an electric field is which prevents the positively charged particles from entering the cathode region via the aperture, by means of a second conducting element on different electric potential than the first conducting element.

14. The method of claim 13, wherein the electric field is parallel to the electron beam.

15. The method of claim 13, wherein the electric field is a deflection field oriented transversally to the electron beam.

* * * * *